US007118350B2

(12) United States Patent
Graf et al.

(10) Patent No.: US 7,118,350 B2
(45) Date of Patent: Oct. 10, 2006

(54) RADIAL PISTON PUMP

(75) Inventors: Ludmilla Graf, Lohr am Main (DE); Uwe Nigrin, Ilmenau (DE); Johann Schneider, Lohr (DE); Ngoc-Tam Vu, Ludwigsburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 11/015,573

(22) Filed: Dec. 17, 2004

(65) Prior Publication Data

US 2005/0100448 A1 May 12, 2005

Related U.S. Application Data

(63) Continuation of application No. PCT/DE03/02024, filed on Jun. 17, 2003.

(30) Foreign Application Priority Data

Jun. 26, 2002 (DE) ..... 102 28 552

(51) Int. Cl.
*F04B 23/12* (2006.01)
*F04B 1/12* (2006.01)

(52) U.S. Cl. ..... 417/206; 417/269; 417/441

(58) Field of Classification Search ..... 417/206, 417/269, 441
See application file for complete search history.

(56) References Cited

U.S. PATENT DOCUMENTS 3,667,868 A * 6/1972 Brunner ..... 417/273
3,670,629 A * 6/1972 Biernath et al. ..... 92/72
4,475,870 A * 10/1984 Eickmann ..... 417/206
4,621,982 A * 11/1986 Schulz et al. ..... 417/201
4,671,743 A * 6/1987 Frey ..... 417/205
4,903,577 A * 2/1990 Loffler ..... 91/488
5,549,452 A * 8/1996 Vogt ..... 417/199.1
6,779,986 B1 * 8/2004 Breuer et al. ..... 417/273

FOREIGN PATENT DOCUMENTS

| | | |
|---|---|---|
| DE | 670401 | 1/1939 |
| DE | 2436321 | 2/1976 |
| DE | 4217259 | 11/1992 |
| DE | 19736160 | 2/1999 |
| DE | 19848035 | 4/2000 |
| DE | 19913774 | 10/2000 |
| GB | 716892 | 10/1954 |

* cited by examiner

*Primary Examiner*—Charles G. Freay
(74) *Attorney, Agent, or Firm*—Baker Botts L.L.P.

(57) ABSTRACT

The invention relates to a radial piston pump unit for a high pressure injection system with a pump housing in which a driveshaft with an eccentric section is mounted. A reciprocating ring sits on the above section and drives at least one spring-loaded piston which may be displaced in a direction radial to the drive axis. The driveshaft is embodied to comprise an end region which as a floating mounting and is also the drive for a fuel supply pump.

19 Claims, 4 Drawing Sheets

RADIAL PISTON PUMP

CROSS-REFERENCE TO RELATED APPLICATION OR PRIORITY

This application is a continuation of co-pending International Application No. PCT/DE03/02024 filed Jun. 17, 2003, which designates the United States, and claims priority to German application number DE10228552.7 filed Jun. 26, 2002.

FIELD OF THE INVENTION

The invention relates to a radial piston pump unit for high-pressure fuel delivery in fuel injection systems of internal combustion engines, in particular for a common rail injection system.

BACKGROUND OF THE INVENTION

A radial piston pump for high-pressure fuel delivery in fuel injection systems of internal combustion engines, in particular for a common rail injection system, is already known from DE 198 48 035 A1. The radial piston pump has a housing in which a drive shaft is mounted. The drive shaft has an eccentric section on which a reciprocating ring is mounted. Supported on the reciprocating ring there are preferably mounted a plurality of pump pistons which can be displaced radially with respect to the drive shaft longitudinally in the pump housing. Each pump piston is assigned a suction valve and a delivery valve. Fuel from the low-pressure area is supplied to the pump piston via the suction valve. After the pressure has built up, the compressed fuel is diverted via the delivery valve.

A radial piston pump of this kind typically has connected ahead of it a fuel pre-feeder pump which supplies the fuel from the fuel tank to the high-pressure pump. The fuel pre feeder pump is usually driven by an electric motor or via the camshaft. In the case of the camshaft drive, the pre-feeder pump can be mounted directly on the camshaft or be driven via a belt. Because of the limited space conditions in the engine compartment it is necessary for the high-pressure fuel pump and the pre-feeder pump to be of as compact a design as possible.

DE 197 36 160 A1 therefore proposes disposing the fuel pre-feeder pump on or in the pump housing of the radial piston pump and driving same via the drive shaft of the radial piston pump. Toward that end, a clutch is inserted between the drive shaft of the radial piston pump and the shaft of the pre-feeder pump.

SUMMARY OF THE INVENTION

The invention is characterized in that the radial piston pump has a drive shaft which has a floating-mounted end region, with a saw tooth profile, for housing a fuel pre-feeder pump. The advantage of the floating mounting is an extremely compact structural design of the radial piston pump unit, since a third bearing of the drive axle is economized. Thanks to the saw tooth profile, the fuel pre-feeder pump simply has to be slotted onto the shaft and secured. No additional components such as, for example, a coupling are required. By this means the radial width dimension of the radial piston pump unit can be further reduced.

A further advantage that results from the compact arrangement of high-pressure pump and fuel pre-feeder pump is that the line from the fuel pre-feeder pump to the suction valve of the high-pressure pump can be reduced to a minimum.

BRIEF DESCRIPTION OF THE DRAWINGS

Example embodiments of the invention will be explained in more detail below with reference to the schematic drawings, in which.

Elements of identical design and function are provided with the same reference symbols in all the figures. The two sections are in each case located normal to the shaft axis, but are displaced at a certain angle relative to each other. This is necessary because the individual components of the radial piston pump unit are distributed around the circumference and only in this way can all the components be represented.

DETAILED DESCRIPTION OF EMBODIMENTS OF THE INVENTION

Figure 1:
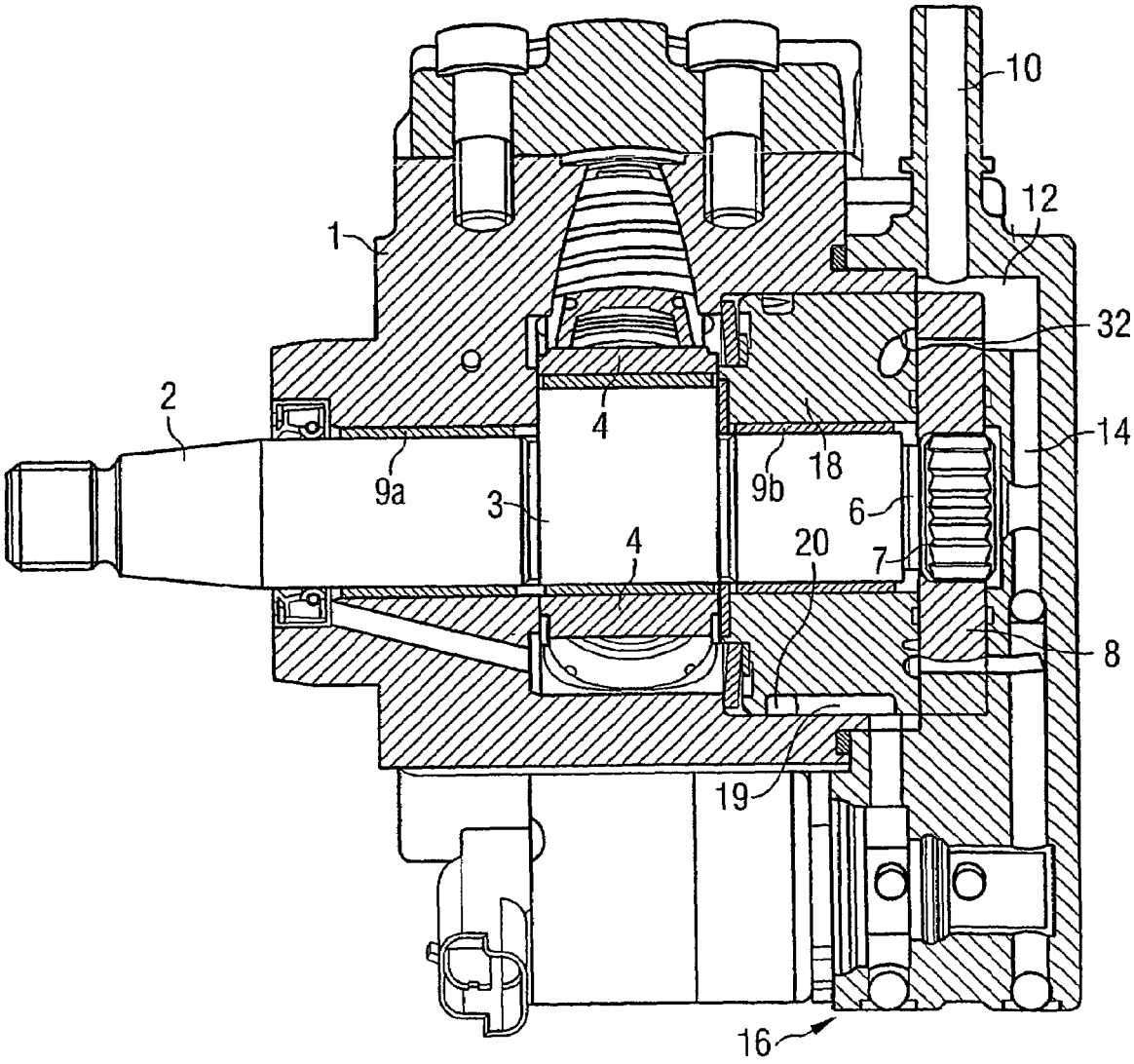
FIG. 1 shows a longitudinal section through the radial piston pump unit.
Figure 2:
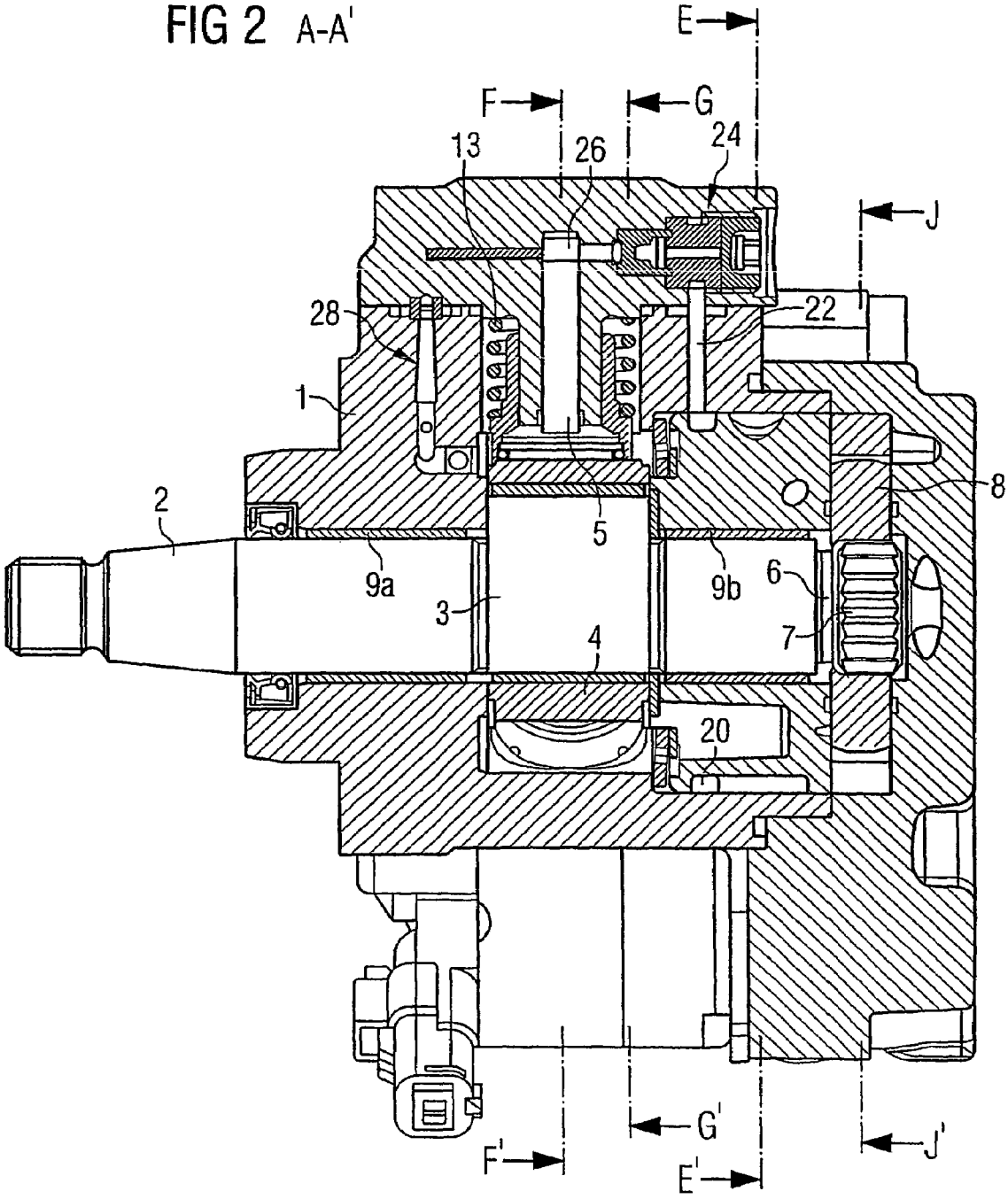
FIG. 2 shows a further longitudinal section through the radial piston pump unit.

A drive shaft 2 (FIG. 1) is mounted in the pump housing 1 over a first shaft bearing 9*a* and a second shaft bearing 9*b*. The drive shaft 2 has an eccentric section 3. Disposed on the eccentric section 3 is a 4 there are preferably mounted three spring-loaded pump pistons 5 which can be displaced in a radial direction relative to the drive shaft (FIG. 2). In this arrangement the pump pistons 5 are disposed in the pump housing 1, preferably offset by 120° to one another, in a radial plane relative to the axis of the drive shaft 2. The drive shaft 2 has a floating-mounted end region 6 which acts at the same time as the drive for a fuel pre-feeder pump 8. In order to accommodate the fuel pre-feeder pump 8, the floating-mounted end region 6 has a saw tooth profile 7.

The pump housing 1 is embodied as a bell housing. The floating-mounted end of the drive shaft 2 sits on the bell side which is open toward the pump housing 1. The open bell side of the pump housing 1 is closed by means of a flange-mounted bell cover 31. The bell cover 31 is embodied such that it simultaneously forms a pump chamber 32 of the fuel pre-feeder pump 8. Also accommodated in the bell cover 31 is the fuel supply line 10, a flow channel 12, a lubrication bore 14 and a volume flow control valve 16. In this way a very compact design of the radial piston pump unit is possible.

In this arrangement the fuel enters the radial piston pump unit through the fuel supply line 10 in the bell cover 31. The fuel is routed to the fuel pre-feeder pump 8 via the flow channel 12. The flow channel is embodied in such a way that the pump chamber 32 can be filled from both sides. The lubrication bore 14 serves for lubricating the fuel pre-feeder pump 8. The fuel is expelled from the fuel pre-feeder pump 8 at a pre-pressure of approx. 5–10 bar and from there reaches the volume flow control valve 16 which is integrated in a space-saving manner into the bell cover 31. From the volume flow control valve 16, the fuel then reaches a control disk 18. The control disk 18 serves in this case to distribute the fuel evenly to the suction valves distributed around the circumference. For this purpose an annular groove 19 is provided circumferentially on the control disk 16.

Each pump piston 5 is assigned a suction valve 24 and a delivery valve 28 in each case. During the suction stroke of the pump piston 5 the suction valve 24 opens and fuel can flow into the cylinder chamber 26. During the compression stroke of the pump piston 5 the fuel is compressed in the cylinder chamber 26. During this process both the suction valve 24 and the delivery valve 28 are closed. At the end of the compression stroke of the pump piston 5 the delivery valve 28 opens and the fuel can flow into the high-pressure line.

Figure 3:
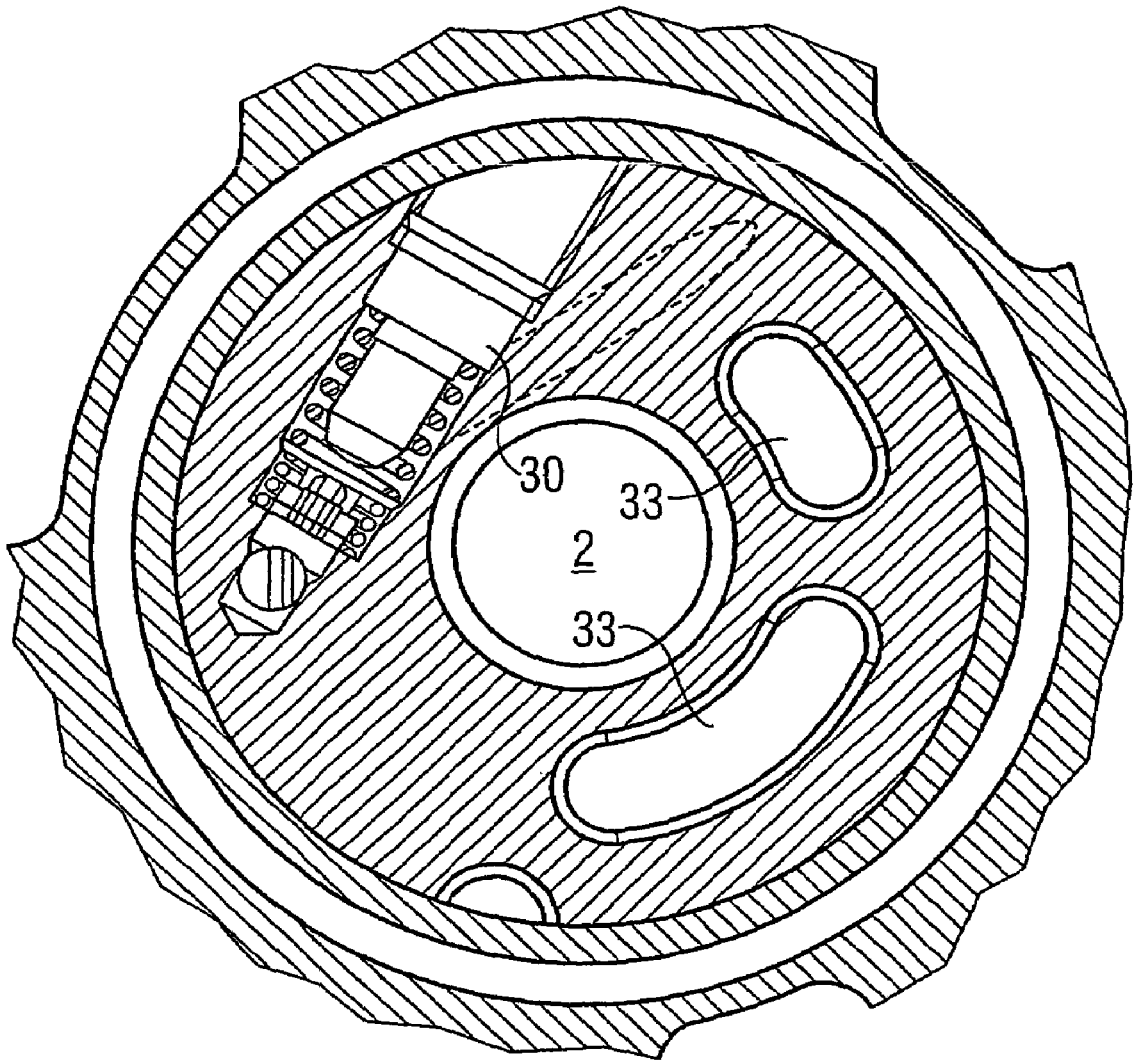
FIG. 3 shows a section longitudinally through a control disk along the intersection line E–E'.

FIG. 3 shows a section through the control disk 18. The sectional axis is identified in FIG. 2 by the axis E–E'. The control disk 16 is permanently connected to the pump housing 1. The control disk 18 has deformation pockets 33 which permit an elastic deformation of the control disk 18, in particular when the drive shaft 2 starts to operate. The control disk 18 has a pressure limiting valve 30 for the fuel pre-feeder pump 8. A vane pump or a blocking vane pump is particularly suitable as a pre-feeder pump.

Figure 4:
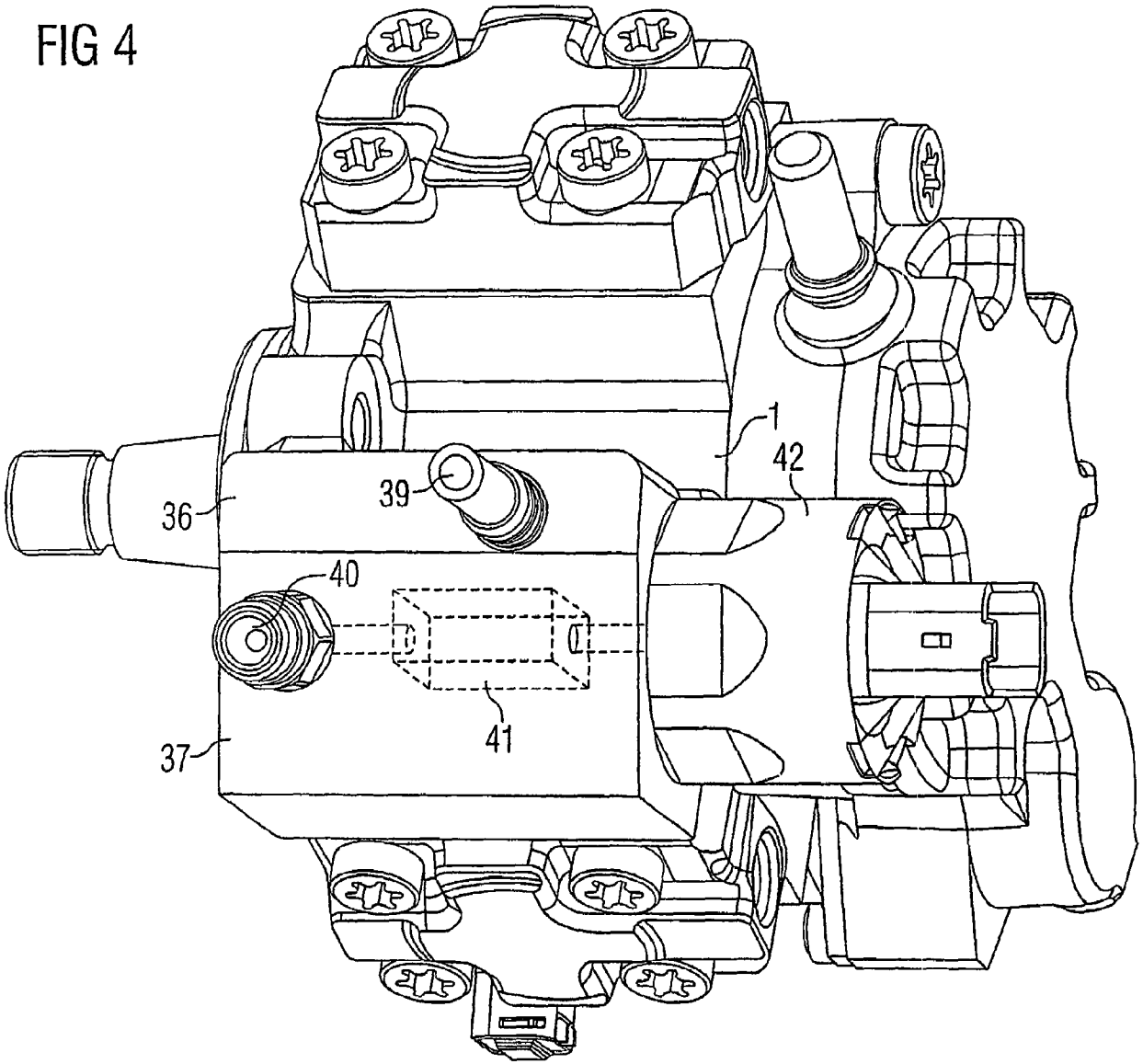
FIG. 4 is a further illustration of the radial piston pump unit.

FIG. 4 shows a schematic representation of a radial piston pump unit. Disposed on the outer circumference of the pump housing 1 are a level plane 36 and a level plane 37 which serve to accommodate the pump connections 39 and 40. Below the connections 39 and 40 there is located the high-pressure accumulator 41 (represented in the figure by the dashed lines) which is integrated in the pump housing 1. The high-pressure accumulator 41 can advantageously be integrated in the pump housing 1 because, as a result of the pump housing 1 being designed as a high-pressure resistant component, there are sufficient reserves of material at certain points of the pump housing 1 to allow the integration of the high-pressure accumulator 41. The integration of the high-pressure accumulator in the pump housing 1 is particularly appropriate if a pressure control valve 42 is being integrated in the high-pressure accumulator at the same time. The high-pressure accumulator 41 is connected to the pressure control valve 42 on the right-hand side, as shown in the drawing. On the left-hand side, as shown in the drawing, there is a line to the connection 40.

The pump housing 1 can be manufactured at low cost from spheroidal graphite cast iron. If very high pressures are to be realized with the radial piston pump unit, the pump housing 1 should preferably be made from spheroidal graphite cast iron with a bainite structure or as a wrought steel part.

The bell cover 31 can preferably be manufactured from aluminum die casting or plastic.

The control disk 16 can preferably be manufactured from steel, plastic or aluminum die casting. A flange mounting can preferably be provided on the pump housing 1 to allow direct fixing of the radial piston pump unit to the engine.

What we claim is:

1. A radial piston pump unit for high pressure injection systems, said unit comprising:

a pump with pistons;

a housing for housing said pump, said pump including a drive shaft for driving the pump pistons of the radial piston pump, said drive shaft having first and second end regions, wherein the second end region is a floating-mounted end region located within said housing adapted to drive a fuel pre-feeder pump providing fuel for said radial piston pump; and a bell cover comprising a volume flow control valve mounted to said housing.

2. A unit according to claim 1, wherein the housing is a bell housing.

3. A unit according to claim 1, wherein the housing is a spheroidal graphite iron part.

4. A unit according to claim 1, wherein the housing is a wrought steel part.

5. A unit according to claim 2, wherein the second end region of the drive shaft is located on the bell side that is open to the pump housing and the pump housing is closed by means of said bell cover via a flange.

6. A unit according to claim 5, wherein the bell cover is manufactured from aluminum or plastic.

7. A unit according to claim 1, wherein a flange mount is provided on the housing for direct connection to an engine.

8. The radial piston pump unit according to claim 1, wherein the bell cover further comprises a fuel supply intake.

9. An improved radial piston pump unit for high pressure fuel injection systems, said unit comprising:

a radial piston pump, and a fuel pre-feeder pump, wherein said radial piston pump has a drive shaft for driving pump pistons, wherein said drive shaft is adapted to also directly drive the fuel pre-feeder pump, said adaptation comprising a floating-mounted end region having a saw toothed profile; and a bell cover comprising a volume flow control valve mounted to a housing of said radial piston pump.

10. The radial piston pump unit according to claim 9, wherein the bell cover further comprises a fuel supply intake.

11. A radial piston pump unit for high-pressure injection systems comprising:

a pump housing having a drive shaft mounted therein, said drive shaft having an eccentric section with a reciprocating ring sitting thereon, said ring adapted for moving at least one spring-loaded pump piston of the radial piston pump, said spring-loaded pump piston displaceable in a direction radial to a drive axle, and a fuel pre-feeder pump connected with the radial piston pump, wherein the drive shaft has a floating-mounted end region, with a saw tooth profile, for driving the fuel pre-feeder pump; and a bell cover comprising a volume flow control valve mounted to said pump housing.

12. The radial piston pump unit according to claim 11, wherein the fuel pre-feeder pump is a vane pump.

13. The radial piston pump unit according to claim 11, wherein the fuel pre-feeder pump is a blocking vane pump.

14. The radial piston pump unit according to claim 11, wherein the pump housing is embodied as a bell housing.

15. The radial piston pump unit according to claim 11, wherein the pump housing is manufactured as a spheroidal graphite cast iron part or as a wrought steel part.

16. The radial piston pump unit according to claim 14, wherein the floating-mounted end region of the drive shaft lies on the bell side that is open to the pump housing and the pump housing is closed by the bell cover via a flange.

17. The radial piston pump unit according to claim 16, wherein the bell cover is manufactured from aluminum die casting or plastic.

18. The radial piston pump unit according to claim 12, wherein a flange mounting is provided on the pump housing to allow direct fixing to the engine.

19. The radial piston pump unit according to claim 11, wherein the bell cover further comprises a fuel supply intake.

* * * * *